US008079863B2

(12) United States Patent
Wason

(10) Patent No.: US 8,079,863 B2
(45) Date of Patent: Dec. 20, 2011

(54) ELECTRICAL TERMINAL WITH HERMAPHIDITIC CONNECTION SECTION

(75) Inventor: Peter M. Wason, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/806,928

(22) Filed: Aug. 23, 2010

(65) Prior Publication Data

US 2011/0065339 A1 Mar. 17, 2011

Related U.S. Application Data

(60) Provisional application No. 61/276,377, filed on Sep. 11, 2009.

(51) Int. Cl.
*H01R 13/28* (2006.01)

(52) U.S. Cl. ..... 439/290; 439/284; 439/877

(58) Field of Classification Search ..... 439/284, 439/877, 849, 850, 290
See application file for complete search history.

(56) References Cited

U.S. PATENT DOCUMENTS

| | | | | | |
|---|---|---|---|---|---|
| 1,179,872 | A | | 4/1916 | Stromquist | |
| 2,580,269 | A | * | 12/1951 | Alvarez | 174/84 C |
| 2,600,188 | A | * | 6/1952 | Batcheller | 439/849 |
| 2,629,763 | A | | 2/1953 | Macy | 173/363 |
| 2,713,673 | A | * | 7/1955 | Batcheller | 439/849 |
| 2,785,387 | A | | 3/1957 | Batcheller | 339/258 |
| 2,877,442 | A | * | 3/1959 | Gettig | 439/861 |
| 3,169,814 | A | * | 2/1965 | Collins | 439/290 |
| 3,514,740 | A | | 5/1970 | Filson | 339/47 |
| 3,516,043 | A | * | 6/1970 | Spofford | 439/287 |
| 3,594,714 | A | * | 7/1971 | Paullus et al. | 439/787 |
| 3,846,735 | A | * | 11/1974 | Carter et al. | 439/284 |
| 4,061,406 | A | * | 12/1977 | Kunkle | 439/291 |
| 4,579,409 | A | * | 4/1986 | Enneper et al. | 439/266 |
| 4,915,653 | A | * | 4/1990 | Mair | 439/781 |
| 5,108,304 | A | * | 4/1992 | Bogiel et al. | 439/290 |
| 5,411,419 | A | * | 5/1995 | Ochi | 439/787 |
| 5,588,884 | A | * | 12/1996 | Rudoy et al. | 439/845 |
| 5,911,605 | A | * | 6/1999 | Wooldridge et al. | 439/790 |
| 6,293,831 | B1 | * | 9/2001 | Yamatani | 439/850 |
| 6,692,316 | B2 | * | 2/2004 | Hsieh et al. | 439/845 |
| 7,033,194 | B1 | * | 4/2006 | Le Beau | 439/290 |
| 7,043,833 | B2 | * | 5/2006 | DiTroia | 29/857 |
| 7,134,893 | B1 | * | 11/2006 | Kalisz et al. | 439/287 |
| 7,309,263 | B2 | * | 12/2007 | Copper et al. | 439/781 |
| 2002/0025732 | A1 | * | 2/2002 | Hsieh | 439/845 |
| 2002/0132507 | A1 | * | 9/2002 | Maeda et al. | 439/284 |

* cited by examiner

*Primary Examiner* — Briggitte R Hammond
(74) *Attorney, Agent, or Firm* — Harrington & Smith

(57) ABSTRACT

An electrical terminal including a first connection section adapted to connect to a first electrical conductor; and a second connection section connected to the first connection section. The second connection section is adapted to removably connect to a mating electrical terminal. The second connection section includes a first lateral side with a first bent section forming an inward facing slot. The second connection section includes an opposite second lateral side with a second bent section which is bent in a direction generally opposite a bend of the first bent section. An angle of the bend of the first bent section is greater than an angle of a bend of the second bent section.

18 Claims, 3 Drawing Sheets

ELECTRICAL TERMINAL WITH HERMAPHIDITIC CONNECTION SECTION

CROSS REFERENCE TO RELATED APPLICATION

This application claims priority on U.S. provisional patent application No. 61/276,377 filed Sep. 11, 2009 which is hereby incorporated by reference in its entirety.

BACKGROUND OF THE INVENTION

1. Field of the Invention

The invention relates to an electrical terminal and, more particularly, to an electrical terminal having a hermaphiditic connection section.

2. Brief Description of Prior Developments

U.S. Pat. No. 3,169,814 discloses a hermaphroditic electric terminal having a contact portion shaped to make connection with another terminal of the same configuration.

SUMMARY

The following summary is merely intended to be exemplary. The summary is not intended to limit the scope of the claimed invention.

In accordance with one aspect of the invention, an electrical terminal is provided including a first connection section adapted to connect to a first electrical conductor; and a second connection section connected to the first connection section. The second connection section is adapted to removably connect to a mating electrical terminal. The second connection section includes a first lateral side with a first bent section forming an inward facing slot. The second connection section includes an opposite second lateral side with a second bent section which is bent in a direction generally opposite a bend of the first bent section. An angle of the bend of the first bent section is greater than an angle of a bend of the second bent section.

In accordance with another aspect of the invention, an electrical terminal is provided comprising a first connection section adapted to connect to a first electrical conductor; and a second connection section connected to the first connection section. The second connection section is sized and shaped to removably connect to a mating electrical terminal which has a mating connection section that is substantially identically sized and shaped the same as the second connection section. The second connection section comprises a first lateral side with a first bent section forming an inward facing slot. The second connection section comprises an opposite second lateral side with a second bent section which is bent in a direction generally opposite a bend of the first bent section and does not form a slot.

In accordance with another aspect of the invention, a method of manufacturing an electrical terminal is provided comprising forming a first connection section adapted to connect to a first electrical conductor; and forming a second connection section connected to the first connection section, wherein the second connection section is sized and shaped to removably connect to a mating electrical terminal which has a mating connection section that is substantially identically sized and shaped the same as the second connection section, wherein the second connection section comprises a first lateral side with a first bent section forming an inward facing slot, wherein the second connection section comprises an opposite second lateral side with a second bent section which is bent in a direction generally opposite the bend of the first bent section and does not form a slot, and wherein an angle of the first bent section is greater than an angle of the second bent section.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENTS

Figure 1:
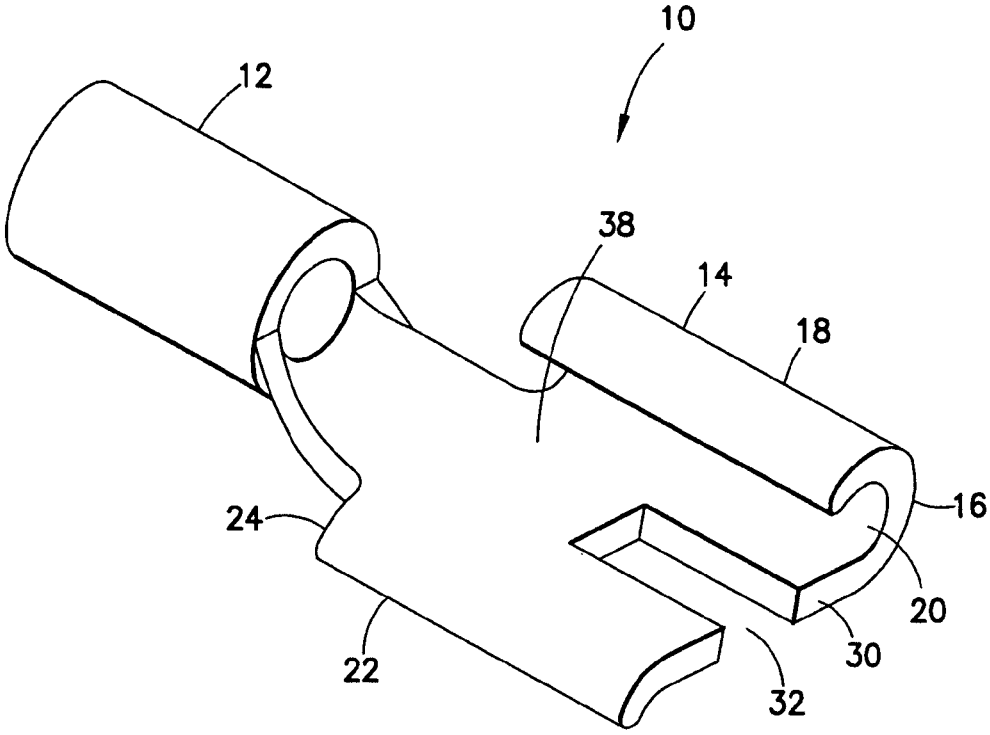
FIG. 1 is a perspective view of an electrical terminal comprising features of the invention.

Referring to FIG. 1, there is shown a perspective view of an electrical terminal 10 incorporating features of the invention. Although the invention will be described with reference to the example embodiments shown in the drawings, it should be understood that the invention can be embodied in many alternate forms of embodiments. In addition, any suitable size, shape or type of elements or materials could be used.

The terminal 10 is a one-piece member made of metal. However, in an alternate embodiment the terminal could be comprised of multiple members and/or a combination of materials. The terminal 10 generally comprises a first connection section 12 and a second connection section 14. The first connection section 12 is adapted to connect to a first electrical conductor (not shown) such as a wire. The second connection section 14 is connected to the first connection section 12. In this example embodiment the second connection section is connected to the first connection section because the first and second connections sections are integrally formed. In the embodiment shown, the first connection section is adapted to be crimped onto the first electrical conductor. However, any suitable connection could be provided.

Figure 2:
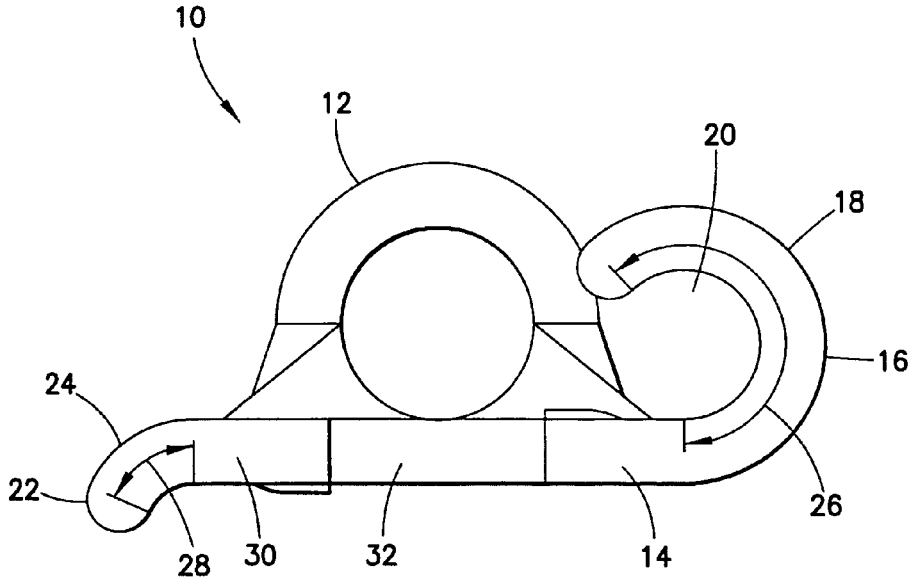
FIG. 2 is a front end view of the terminal shown in FIG. 1.

The second connection section 14 is adapted to be removably connected to a mating electrical terminal 10' (see FIG. 3), such as a terminal which is the same as the terminal 10 for example. Referring also to FIG. 2, the second connection section 14 comprises a first lateral side 16 with a first bent section 18 forming an inward facing slot 20. The second connection section 14 also comprises an opposite second lateral side 22 with a second bent section 24 which is bent in a direction generally opposite a bend of the first bent section 18. In this example embodiment the first bent section 18 is bent generally upward and the second bent section 24 is bent generally downward. The first bent section 18 is also bent generally inward.

An angle 26 of the bend of the first bent section 18 is greater than an angle 28 of a bend of the second bent section 24. In this particular example embodiment, the angle 26 is about 224 degrees and the angle 28 is about 66 degrees. However, in alternate embodiments any suitable angles for the angles 26, 28 could be provided, but the angle 26 is preferably 180 degrees or more and the angle 28 is preferably 90 degrees or less. In the example embodiment shown the bent sections 18, 24 are curved in a uniform radius. However, in alternate embodiments any suitable shape for the bent sections could be provided.

Figure 3:
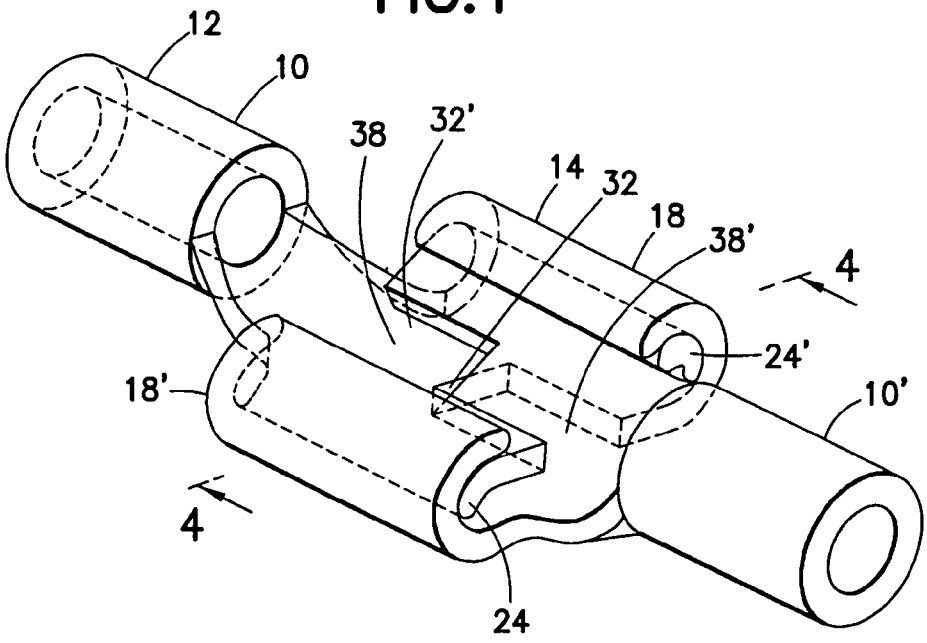
FIG. 3 is a perspective view of two of the terminals shown in FIG. 1 connected to each other.
Figure 4:
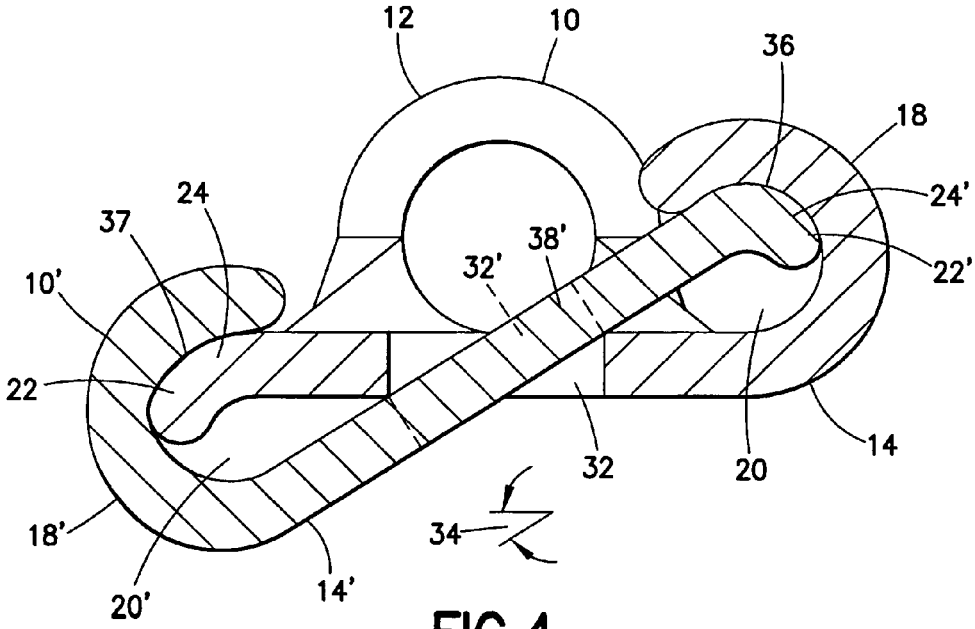
FIG. 4 is a cross sectional view of the connection shown in FIG. 3 taken along line 4-4.

The front end 30 of the terminal 10 has a slot 32. The slot 32 is sized, shaped and positioned to interlock with a mating slot of the mating terminal 10' during connection. Referring also to FIGS. 3-4, the terminal 10 is shown connected to the mating terminal 10'. In this example embodiment the terminals 10, 10' are identical. The second connection section 14 is a hermaphiditic connection section which is sized and shaped to connect to a terminal having a connection section with a same size and shape. When the two terminals 10, 10' are connected to each other the two second connection sections 14, 14' interlockingly mate. The second lateral side 22' of the second terminal 10' is received in the slot 20 of the first bent section 18 of the first terminal 10. The second lateral side 22 of the first terminal 10 is received in the slot 20' of the first bent section 18' of the second terminal 10'. The outer surface of the second bent sections 24, 24' generally corresponds to the inner surface of the first bent sections 18, 18' in the slots 20, 20' for good areas 36, 37 of electrical contact between the terminals 10, 10'. The surfaces at the areas 36, 37 generally slide against each other when the terminals 10, 10' are being connected together.

The two slots 32, 32' interlock with each other during mating, but at an angle 34 such as about 30 degrees for example. Thus, sections 38, 38' of the terminals 10, 10' are received in the slots 32, 32' when the terminals are mated. The shapes of the lateral sides 16, 22 allow a hermaphiditic connection section to be provided, but with minimal forming of the lateral sides during manufacture. This can reduce stresses and strains in the terminal and produce a better quality product than a terminal which requires greater bending during manufacture. Manufacturing costs can also be less expensive with the reduced amount of bending.

Figure 5:
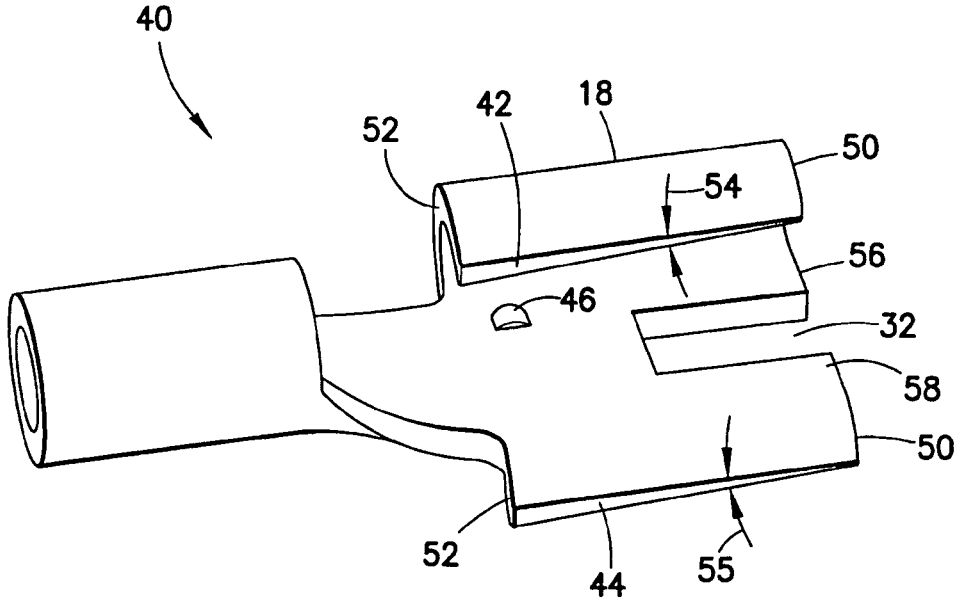
FIG. 5 is a perspective view of an alternate embodiment of the invention.
Figure 6:
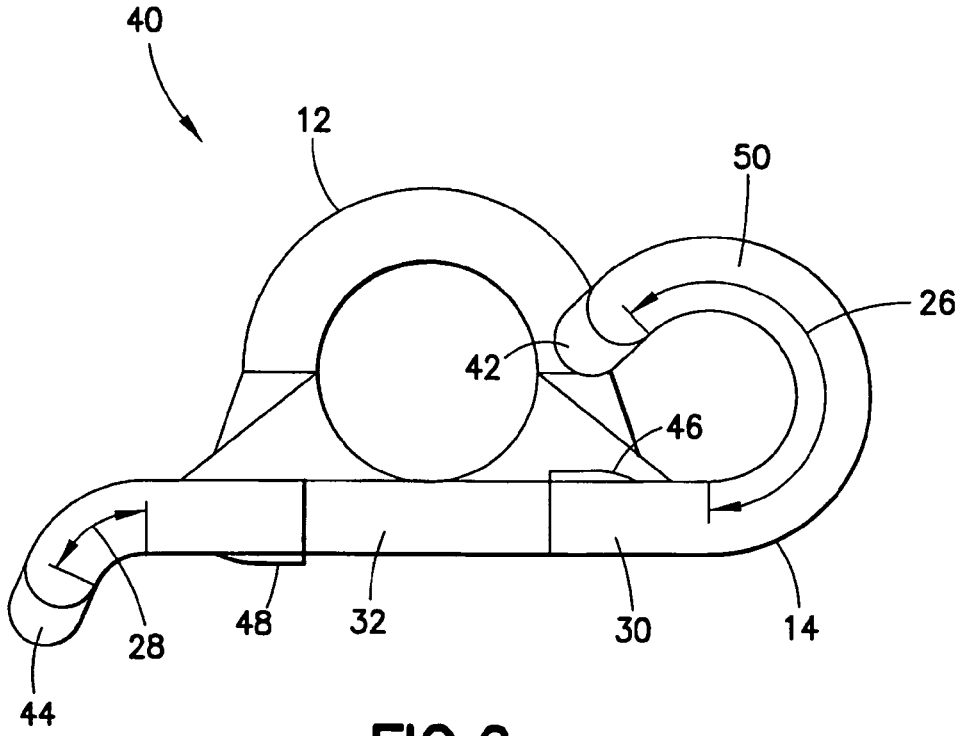
FIG. 6 is a front end view of the terminal shown in FIG. 5.

Referring also to FIGS. 5-6, another embodiment of the invention is shown. In this example embodiment the terminal 40 is identical to the terminal 10 except of the edges 42, 44 at the bent sections 18, 22, and the addition of retention cams 46, 48. The edge 42 at the first bent section 18 is angled from the front 50 to the rear 52 at an angle 54. In this embodiment the angle 54 are about 3.5 degrees each. The edge 44 at the second bent section 22 is angled from the front 50 to the rear 52 at an angle 55. In this embodiment the angles 54, 55 is about 3.5 degrees. However, in alternate embodiments any suitable angles could be provided. The angles 26, 28 are the same as the first embodiment, but the rears of the edges 42, 44 extend further than the fronts of the edges. The tapered angled edges 42, 44 can assist in easier insertion of two terminals 40 together. The retention cams 46, 48 can cam the front blades 56, 58 (on opposite sides of the slot 32) of the mating terminal into a stronger frictional engagement with the mating terminal 40. The mating terminal could have a different first connection section.

With the invention an electrical terminal 10, 40 can be provided comprising a first connection section adapted to connect to a first electrical conductor; and a second connection section 14 connected to the first connection section, wherein the second connection section is adapted to removably connect to a mating electrical terminal. The second connection section 14 can comprise a first lateral side 16 with a first bent section 18 forming an inward facing slot 20. The second connection section 14 can comprise an opposite second lateral side 22 with a second bent section 24 which is bent in a direction generally opposite a bend of the first bent section. An angle 26 of the bend of the first bent section is greater than an angle 28 of a bend of the second bent section. The second bent section 24 does not form a slot. An edge 42 of the first bent section can extend in an inward direction from a front end 50 of the edge to a back end 52 of the edge at an angle 54. An edge 44 of the second bent section can extend in an outward direction from a front end 50 of the edge of the second bent section to a back end 52 of the edge of the second bent section at an angle. The second connection section 14 can be sized and shaped to removably connect to a mating connection section of the mating electrical terminal that is substantially identically sized and shaped the same as the second connection section. The second connection section 14 can comprise a slot 32 extending into a front end 30 of the second connection section, wherein the slot 32 is adapted to interlock with a mating slot of the mating connection section of the mating electrical terminal at an angle.

With the invention, a method of manufacturing an electrical terminal 10, 40 can be provided comprising forming a first connection section 12 adapted to connect to a first electrical conductor; and forming a second connection section 12 connected to the first connection section, wherein the second connection section is sized and shaped to removably connect to a mating electrical terminal which has a mating connection section that is substantially identically sized and shaped the same as the second connection section. The second connection section 14 can be formed with a first lateral side 16 with a first bent section 18 forming an inward facing slot 20, and an opposite second lateral side 22 with a second bent section 24 which is bent in a direction generally opposite the bend of the first bent section and does not form a slot, and wherein an angle 26 of the first bent section is greater than an angle 28 of the second bent section.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. An electrical terminal comprising:

a first connection section adapted to connect to a first electrical conductor; and a second connection section integrally formed with the first connection section as a one piece member, wherein the second connection section is adapted to removably connect to a mating electrical terminal, wherein the second connection section comprises a center section, a first lateral section extending from a first lateral side of the center section, where the first lateral section is upwardly bent forming an inward facing slot, and an opposite second lateral section extending from a second opposite lateral side of the center section, where the second lateral section is downwardly bent away from a bottom side of the center section in a direction generally opposite a bend of the first lateral section, and wherein an angle of the bend of the first lateral section is greater than an angle of a bend of the second lateral section.

2. An electrical terminal as in claim 1 wherein the angle of the bend of the second lateral section is about 66°.

3. An electrical terminal as in claim 1 wherein the second lateral section does not form a slot.

4. An electrical terminal as in claim 1 wherein an edge of the second lateral section extends in an outward direction from a front end of the edge to a back end of the edge at an angle.

5. An electrical terminal as in claim 1 wherein the angle of the bend of the first lateral section is about 224°.

6. An electrical terminal as in claim 5 wherein the angle of the bend of the second lateral section is about 66°.

7. An electrical terminal as in claim 1 wherein an edge of the first lateral section extends in an inward direction from a front end of the edge to a back end of the edge at an angle.

8. An electrical terminal as in claim 7 wherein an edge of the second lateral section extends in an outward direction from a front end of the edge of the second bent section to a back end of the edge of the second bent section at an angle.

9. An electrical terminal as in claim 1 wherein the second connection section is sized and shaped to removably connect to a mating connection section of the mating electrical terminal that is substantially identically sized and shaped the same as the second connection section.

10. An electrical terminal as in claim 9 wherein the second connection section comprises a slot extending into a front end of the center section, and wherein the slot is adapted to interlock with a mating slot of the mating connection section of the mating electrical terminal at an angle during mating.

11. An electrical connection comprising:

an electrical terminal as in claim 9; and the mating electrical terminal connected to the second connection section.

12. An electrical terminal comprising:

a first connection section adapted to connect to a first electrical conductor; and a second connection section connected to the first connection section, wherein the second connection section is sized and shaped to removably connect to a mating electrical terminal which has a mating connection section that is substantially identically sized and shaped the same as the second connection section, wherein the second connection section comprises a first lateral side with a first bent section forming an inward facing slot, where an inner surface of the first lateral side at the slot forms a first contact surface which is sized and shaped to contact the mating electrical terminal, wherein the second connection section comprises an opposite second lateral side with a second bent section which is bent in a direction generally opposite a bend of the first bent section and does not form a slot, where an outer surface of the second lateral side forms a second contact surface which is sized and shaped to contact the mating electrical terminal, wherein the second connection section comprises a second slot extending into a front end of the second connection section, and wherein the second slot is adapted to interlock with a mating slot of a mating connection section of the mating electrical terminal at an angle during mating.

13. An electrical terminal as in claim 12 wherein an edge of the second bent section extends in an outward direction from a front end of the edge to a back end of the edge at an angle.

14. An electrical terminal as in claim 12 wherein an angle of the bend of the first bent section is about 224°.

15. An electrical terminal as in claim 14 wherein an angle of the bend of the second bent section is about 66°.

16. An electrical terminal as in claim 12 wherein an edge of the first bent section extends in an inward direction from a front end of the edge to a back end of the edge at an angle.

17. An electrical terminal as in claim 16 wherein an edge of the second bent section extends in an outward direction from a front end of the edge of the second bent section to a back end of the edge of the second bent section at an angle.

18. A method of manufacturing an electrical terminal comprising:

forming a first connection section adapted to connect to a first electrical conductor; and forming a second connection section connected to the first connection section, wherein the second connection section is sized and shaped to removably connect to a mating electrical terminal which has a mating connection section that is substantially identically sized and shaped the same as the second connection section, wherein the second connection section comprises a first lateral side with a first bent section forming an inward facing slot, where an inner surface of the first lateral side at the slot forms a first contact surface which is sized and shaped to contact the mating electrical terminal, wherein the second connection section comprises an opposite second lateral side with a second bent section which is bent in a direction generally opposite the bend of the first bent section and does not form a slot, where an outer surface of the second lateral side forms a second contact surface which is sized and shaped to contact the mating electrical terminal, and wherein an angle of the first bent section is greater than an angle of the second bent section.

* * * * *